US011820141B2

(12) United States Patent
Osuki

(10) Patent No.: US 11,820,141 B2
(45) Date of Patent: Nov. 21, 2023

(54) ELEMENT SUBSTRATE, LIQUID EJECTION HEAD, LIQUID EJECTION APPARATUS, AND MANUFACTURING METHOD

(71) Applicant: CANON KABUSHIKI KAISHA, Tokyo (JP)

(72) Inventor: Yohei Osuki, Chiba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 2 days.

(21) Appl. No.: 17/537,795

(22) Filed: Nov. 30, 2021

(65) Prior Publication Data

US 2022/0184950 A1 Jun. 16, 2022

(30) Foreign Application Priority Data

Dec. 14, 2020 (JP) ..... 2020-206567

(51) Int. Cl.
*B41J 2/14* (2006.01)
*B41J 2/175* (2006.01)
*B41J 2/16* (2006.01)

(52) U.S. Cl.
CPC ..... *B41J 2/14072* (2013.01); *B41J 2/14153* (2013.01); *B41J 2/1753* (2013.01); *B41J 2/1601* (2013.01); *B41J 2/164* (2013.01); *B41J 2/1626* (2013.01)

(58) Field of Classification Search
CPC ... B41J 2/14072; B41J 2/14153; B41J 2/1753
See application file for complete search history.

(56) References Cited

U.S. PATENT DOCUMENTS 6,431,678 B2 * 8/2002 Beck ..... B41J 2/14153 347/19
8,246,147 B2 * 8/2012 Tamura ..... B41J 2/1601 347/50
2009/0309930 A1 12/2009 Tamura et al.

FOREIGN PATENT DOCUMENTS

JP 2010-23480 A 2/2010

* cited by examiner

*Primary Examiner* — Geoffrey S Mruk
(74) *Attorney, Agent, or Firm* — VENABLE LLP

(57) ABSTRACT

An element substrate of a liquid ejection head includes an ejection element for ejecting a liquid, a plurality of electrode pads for receiving power for causing the ejection element to eject the liquid, and a sensor for detecting that the liquid has invaded the vicinity of the plurality of electrode pads. The sensor has first wiring connected with one electrode pad of the plurality of electrode pads and second wiring connected with one electrode pad different from the electrode pad connected with the first wiring.

14 Claims, 13 Drawing Sheets

ELEMENT SUBSTRATE, LIQUID EJECTION HEAD, LIQUID EJECTION APPARATUS, AND MANUFACTURING METHOD

BACKGROUND OF THE INVENTION

Field of the Invention

The present invention relates to an element substrate, a liquid ejection head, a liquid ejection apparatus, and a manufacturing method.

Description of the Related Art

In a liquid ejection head for ejecting a liquid according to an ejection signal, a definition of ejection elements and a wiring structure for supplying power to the ejection elements becomes higher and higher. Some of such liquid ejection heads protect, with a sealing member such as a resin, a connection portion between an element substrate on which the ejection elements are formed and a wiring substrate for supplying power to this element substrate to prevent corrosion, wire break, or the like caused by adhesion of ink to a wiring portion.

However, the element substrate and the sealing member have a different coefficient of linear expansion and in some cases, the sealing member gradually comes off from the surface of the element substrate during use of the liquid ejection head. In addition, also in a case where the liquid ejection head has been put in a hot and humid environment for a long time, in some cases, a material for the sealing member gradually changes to cause a crack or cause the sealing member to come off from the element substrate. In this case, there arises a possibility that ink invades an electric connection portion between the element substrate and the wiring substrate and that it is impossible to send an appropriate ejection signal to individual ejection elements arranged on the element substrate.

Japanese Patent Laid-Open No. 2010-23480 discloses a configuration in which wiring for detection to be dissolved by contact with ink is arranged in the vicinity of an electric connection portion to detect a change in a resistance value of the wiring for detection, thereby preventing in advance ink from invading the electric connection portion.

However, the configuration of Japanese Patent Laid-Open No. 2010-23480 requires a certain amount of time from when the ink contacts the wiring for detection until the wiring is dissolved and the change in the resistance value is detected. During this time, the ink sometimes invades as far as the electric connection portion.

SUMMARY OF THE INVENTION

The present invention has been accomplished to solve the above-described problems. Thus, an object of the present invention is to detect an invasion of the vicinity of an electric connection portion by a liquid at appropriate timing to prevent in advance the liquid from contacting the electric connection portion.

In a first aspect of the present invention, there is provided an element substrate of a liquid ejection head comprising: an ejection element configured to eject a liquid; a plurality of electrode pads configured to externally receive power for causing the ejection element to eject the liquid; and a sensor configured to detect that the liquid has invaded a vicinity of the plurality of electrode pads, wherein the sensor comprises first wiring electrically connected with one electrode pad of the plurality of electrode pads and second wiring electrically connected with one electrode pad different from the electrode pad connected with the first wiring of the plurality of electrode pads.

In a second aspect of the present invention, there is provided a liquid ejection head comprising: an element substrate including: an ejection element configured to eject a liquid; a plurality of electrode pads configured to externally receive power for causing the ejection element to eject the liquid; and a sensor configured to detect that the liquid has invaded a vicinity of the plurality of electrode pads, an ejection port plate which is laminated on the element substrate, and on which a plurality of ejection ports for ejecting the liquid by a plurality of the ejection elements and a flow passage for leading the liquid to each of the plurality of ejection ports are formed; and a wiring substrate on which a plurality of electrode leads for being electrically connected with the plurality of electrode pads respectively are formed, wherein the sensor comprises first wiring electrically connected with one electrode pad of the plurality of electrode pads and second wiring electrically connected with one electrode pad different from the electrode pad connected with the first wiring of the plurality of electrode pads.

In a third aspect of the present invention, there is provided a liquid ejection apparatus capable of mounting a liquid ejection head, the liquid ejection head comprising: an element substrate including: an ejection element configured to eject a liquid; a plurality of electrode pads configured to externally receive power for causing the ejection element to eject the liquid; and a sensor configured to detect that the liquid has invaded a vicinity of the plurality of electrode pads, an ejection port plate which is laminated on the element substrate, and on which a plurality of ejection ports for ejecting the liquid by a plurality of the ejection elements and a flow passage for leading the liquid to each of the plurality of ejection ports are formed; and a wiring substrate on which a plurality of electrode leads for being electrically connected with the plurality of electrode pads respectively are formed, wherein the sensor comprises first wiring electrically connected with one electrode pad of the plurality of electrode pads and second wiring electrically connected with one electrode pad different from the electrode pad connected with the first wiring of the plurality of electrode pads, and the liquid ejection apparatus comprises a detection unit configured to detect a resistance value between the electrode pad electrically connected with the first wiring and the electrode pad electrically connected with the second wiring of the plurality of electrode pads, and a determination unit configured to determine that the liquid has invaded the vicinity of the plurality of electrode pads in a case where the resistance value detected by the detection unit goes below a predetermined threshold value.

In a fourth aspect of the present invention, there is provided a manufacturing method of an element substrate of a liquid ejection head comprising: a step of laminating a conductive wiring layer on a front surface of a first insulation layer; a step of etching the wiring layer to form intra-layer wiring; a step of laminating a second insulation layer on the front surface of the first insulation layer on which the intra-layer wiring is formed; a step of forming, in the second insulation layer, a through hole which is connected with the intra-layer wiring; a step of laminating an anti-cavitation film made of corrosion-resistant metal on a front surface of the second insulation layer in which the through hole is formed; and a step of performing patterning on the anti-cavitation film to form a plurality of electrode pads, first wiring, and second wiring, wherein the first wiring is electrically connected with one electrode pad of the plurality of electrode pads via the through hole and the intra-layer wiring and the second wiring is electrically connected with one electrode pad different from the electrode pad connected with the first wiring of the plurality of electrode pads via the through hole and the intra-layer wiring.

Further features of the present invention will become apparent from the following description of exemplary embodiments with reference to the attached drawings.

DESCRIPTION OF THE EMBODIMENTS

Figure 1:
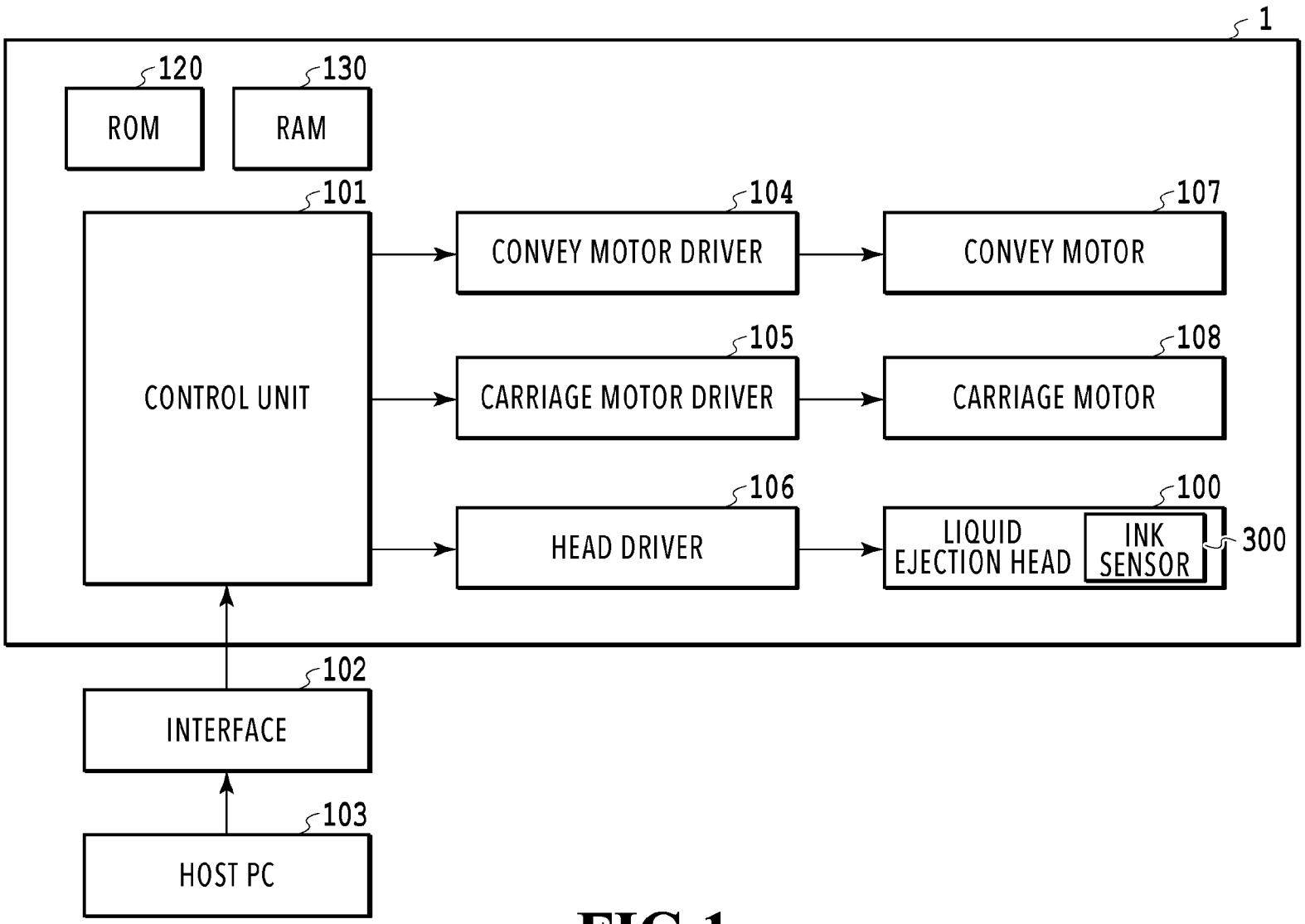
FIG. 1 is a block diagram showing a configuration of control of a liquid ejection apparatus.

FIG. 1 is a block diagram showing a configuration of control of a liquid ejection apparatus 1 which can be used in the present embodiment. The liquid ejection apparatus 1 of the present embodiment is an inkjet printing apparatus which ejects ink to print an image on a print medium.

A control unit 101 controls the entire liquid ejection apparatus 1 according to a program stored in a ROM 120 using a RAM 130 as a work area. The control unit 101 prints the image according to image data supplied from a data supply apparatus such as a host computer 103 via an interface 102.

A convey motor driver 104 drives a convey motor 107 for conveying the print medium. A carriage motor driver 105 drives a carriage motor 108 for scanning a liquid ejection head 100. A head driver 106 drives the liquid ejection head 100 according to ejection data.

The liquid ejection head 100 is provided with an ink sensor 300 for detecting whether the ink has invaded the vicinity of an electric connection portion (not shown in FIG. 1). The control unit 101 is capable of determining whether the ink has invaded the vicinity of the electric connection portion of the liquid ejection head 100 based on the detection value of the ink sensor 300. The configuration of the ink sensor 300 and the above-described determining method will be described later in detail. Incidentally, the liquid ejection head 100 of the present embodiment is detachably mounted on the liquid ejection apparatus 1.

Figure 2:
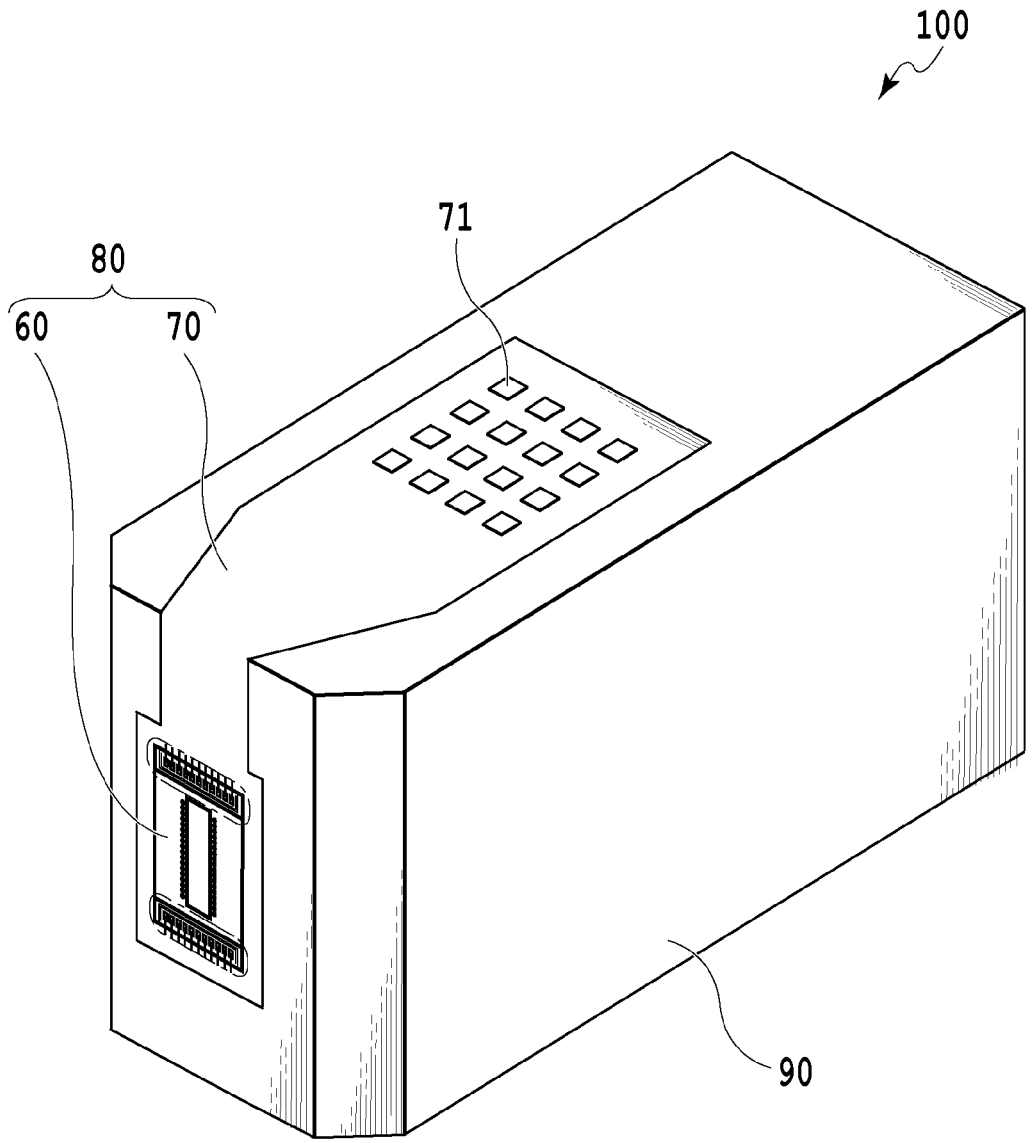
FIG. 2 is a diagram showing an example of a liquid ejection head.

FIG. 2 is a diagram showing an example of the liquid ejection head 100 which can be used in the present embodiment. The liquid ejection head 100 includes an ink tank 90 accommodating the ink and an ejection unit 80 for ejecting the ink supplied from the ink tank 90 according to the ejection data.

The ejection unit 80 has an ejection chip 60 in which a structure for actually ejecting the ink is formed, and a flexible wiring substrate 70 for supplying power and an ejection signal to the ejection chip 60 from a main body of the liquid ejection apparatus 1. The flexible wiring substrate 70 of a film shape curves along the outer surface of the ink tank 90. One end of the flexible wiring substrate 70 is connected with the ejection chip 60 and on the other end there is arranged a contact pad 71 for receiving the power and the ejection signal from the liquid ejection apparatus 1.

Figure 3:
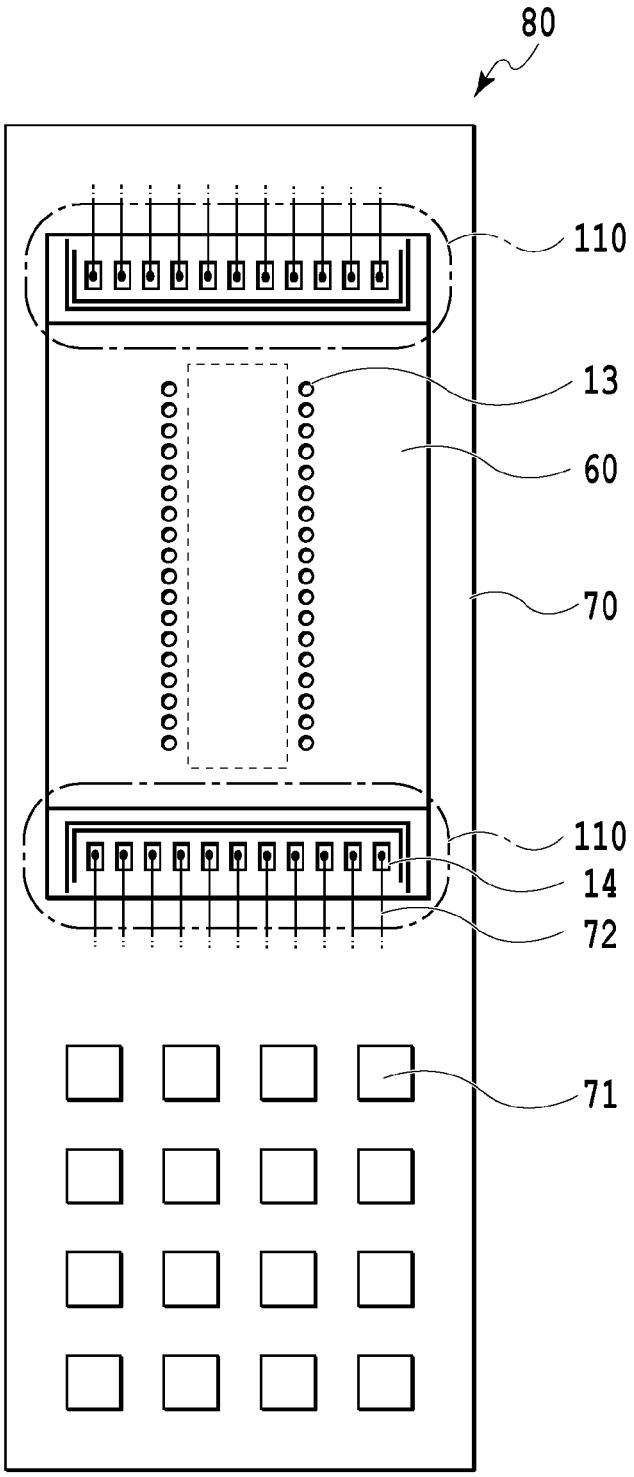
FIG. 3 is an enlarged view of an ejection unit.

FIG. 3 is an enlarged view of the ejection unit 80. FIG. 3 shows a state in which the ejection unit 80 before being attached to the ink tank 90 is viewed from the side of an ejection port surface. An opening is arranged on the one end of the flexible wiring substrate 70 and the ejection port surface of the ejection chip 60 is exposed at this opening. A plurality of electrode pads 14 provided on the ejection chip 60 are electrically connected with a plurality of electrode leads 72 provided on the flexible wiring substrate 70 by Tape Automated Bonding (TAB) technology or the like. After that, a sealing member 110 made of a resin material is applied to an area indicated by a broken line in FIG. 3 to prevent the invasion of the ink and corrosion.

Figure 4A:
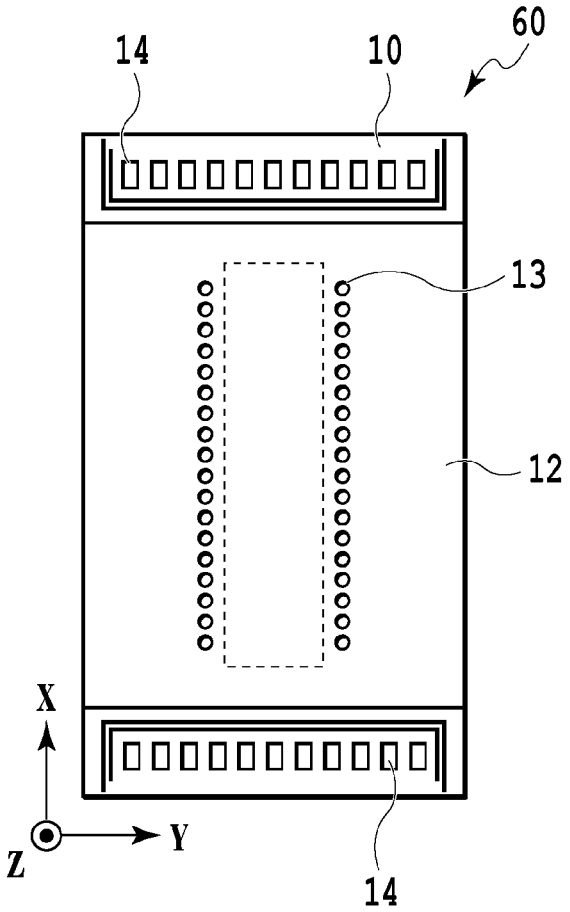
FIGS. 4A to 4C are diagrams showing a schematic structure of an ejection chip.
Figure 4B:
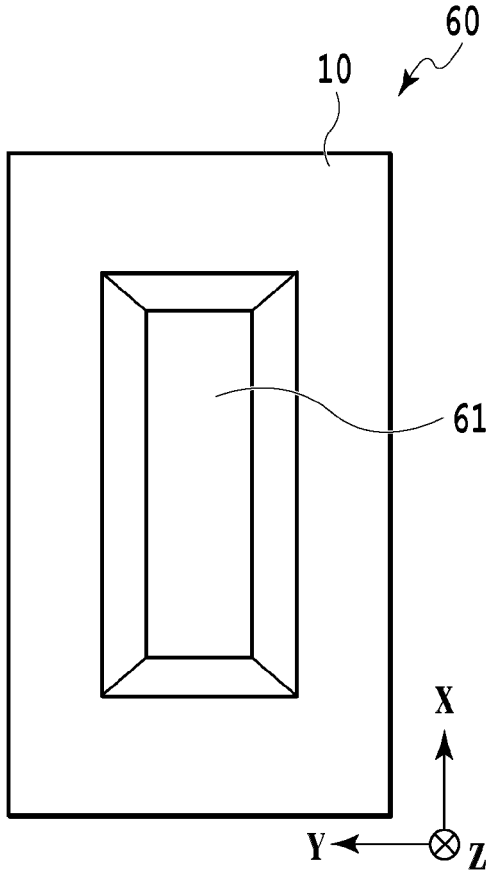
Figure 4C:
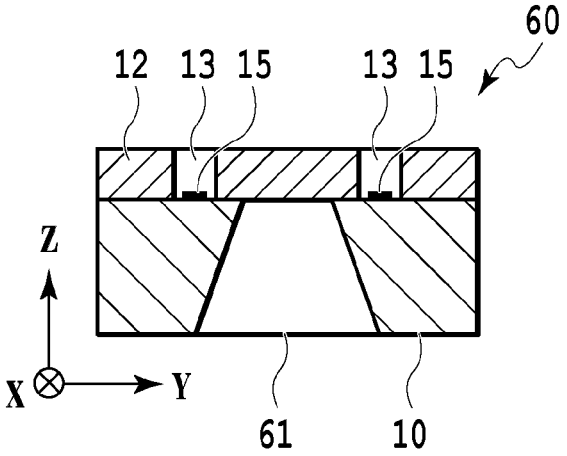

FIGS. 4A to 4C are diagrams showing a schematic structure of the ejection chip 60. FIG. 4A is a diagram in which the ejection chip 60 is viewed from the side of the ejection port surface (front surface), FIG. 4B is a diagram in which the ejection chip 60 is viewed from the side of a surface opposite to the ejection port surface (back surface), and FIG. 4C is a cross-sectional view of the ejection chip 60. In FIGS. 4A to 4C, a longitudinal direction of the ejection chip 60 is an X direction, a transverse direction of the ejection chip 60 is a Y direction, and a direction going from the back surface to the front surface of the ejection chip 60 is a Z direction.

The ejection chip 60 is formed by laminating an element substrate 10 and an ejection port plate 12. An ink supply port 61 is formed on the element substrate 10 so as to penetrate the element substrate 10 from the back surface to the front surface. On the front surface of the element substrate 10, a plurality of ejection elements 15 which are electrothermal conversion elements are arranged in the X direction on either side in the Y direction of the ink supply port 61. Further, the plurality of electrode pads 14 for externally receiving the power for causing each of the ejection elements 15 to eject a liquid are arranged on either end in the X direction of the element substrate 10.

The ejection port plate 12 is laminated on the element substrate 10 at the center in the X direction such that the electrode pads 14 are not covered. Ejection ports 13 arranged at positions corresponding to the individual ejection elements 15 and a flow passage for leading the ink from the ink supply port 61 to each of the ejection ports 13 are formed on the ejection port plate 12. The ink supplied from the ink supply port 61 is led by the flow passage and forms menisci before the ejection ports 13. Upon application of a voltage pulse to the ejection elements 15 in response to the ejection signal, film boiling occurs in the ink and the ink is ejected from the corresponding ejection port 13 by the growth energy of generated bubbles.

Most of the ink ejected from the ejection ports 13 adheres to the print medium. In some cases, the ink rebounds from the print medium to adhere to the ejection port surface or the ink adheres to the ejection port surface after becoming mist floating in the apparatus. The sealing member 110 (see FIG. 3) protects the electric connection portion between the electrode pads 14 and the electrode leads 72 such that the ink adhering to the ejection port surface in the manner described above does not contact the electric connection portion.

In the liquid ejection head 100 for ejecting the liquid using the electrothermal conversion elements as in the present embodiment, when ejection operation is performed the temperature rises and when the ejection operation is stopped the temperature drops. Therefore, the liquid ejection head 100 repeats heat expansion and contraction according to a use state thereof. At this time, since different members, for example, the element substrate 10 and the sealing member 110 have a different coefficient of linear expansion, interfaces of these different members sometimes come off or have a crack by repeating the above-described heat expansion and contraction. In addition, in a case where the liquid ejection head 100 has been put in a hot and humid environment for a long time, in some cases, a material for the sealing member 110 gradually changes to cause the crack or to cause the sealing member 110 to come off from the element substrate 10.

In this case, in a case where the ink adhering to the ejection port surface invades the sealing member 110 through the crack or a come-off area to contact the electric connection portion, an appropriate ejection signal is not sent to the individual ejection elements 15 arranged on the element substrate 10 and defective ejection or the like is incurred. In light of such concern, in the present embodiment, even in a case where the ink adhering to the ejection port surface invades the vicinity of the electric connection portion, a configuration to detect the ink invasion before the ink reaches the electric connection portion is prepared.

In the present embodiment, the configuration to detect the ink invasion will be described below with reference to several examples. Incidentally, in the following examples, a member indicated by the same numeral as in the above description has the same function as in the above description.

Example 1

Figure 5:
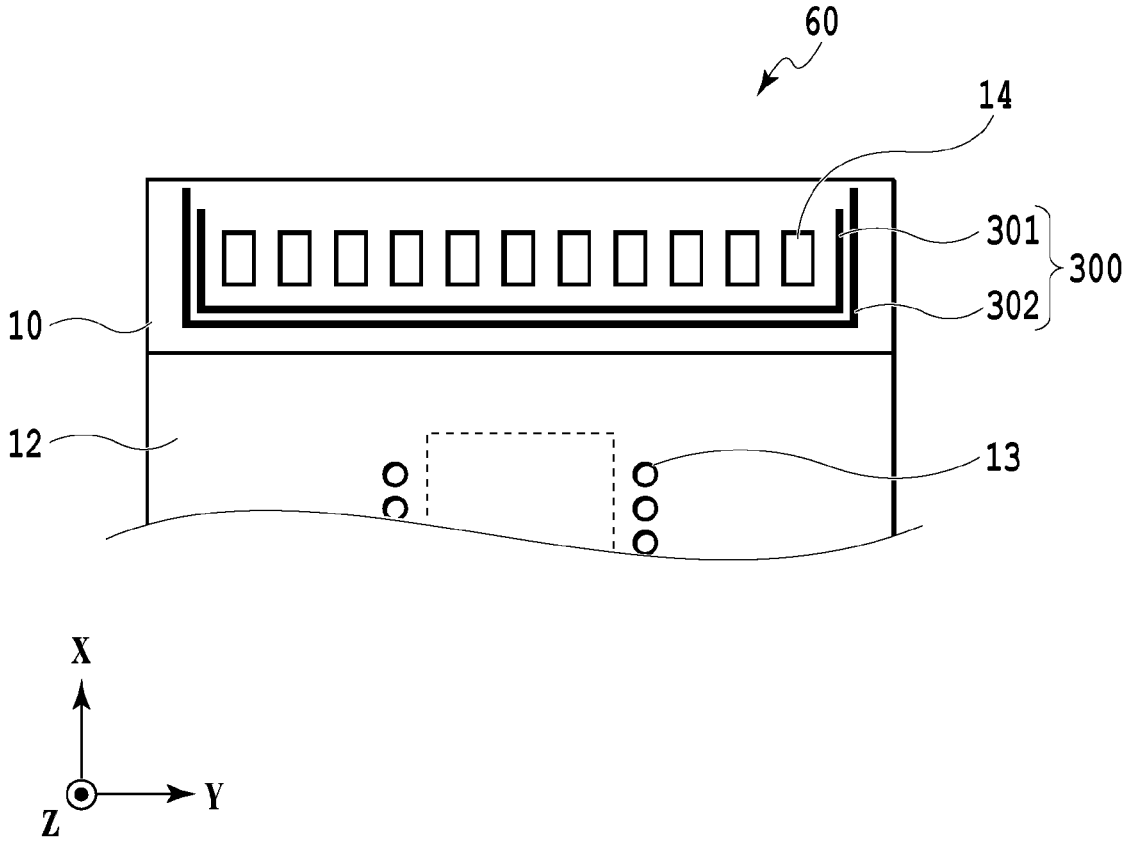
FIG. 5 is a top view showing the ejection chip of Example 1.

FIG. 5 is a top view showing the ejection chip 60 of Example 1. In FIG. 5, one end in the longitudinal direction of the ejection chip 60 is shown in an enlarged view. In the ejection chip 60, the element substrate 10 is exposed in an end area in which the ejection port plate 12 is not arranged. In the exposed area, first wiring 301 and second wiring 302 lined in parallel with a predetermined distance therebetween extend in a U-shape so as to surround the plurality of electrode pads 14. In the present example, the first wiring 301 and the second wiring 302 correspond to the ink sensor 300 described with reference to FIG. 1. The first wiring 301 is electrically connected with one electrode pad 14 of the plurality of electrode pads 14 in the element substrate 10, although this matter is not shown in FIG. 5. The second wiring 302 is also electrically connected, in the element substrate 10, with one electrode pad different from the electrode pad connected with the first wiring 301 of the plurality of electrode pads 14.

Figure 6:
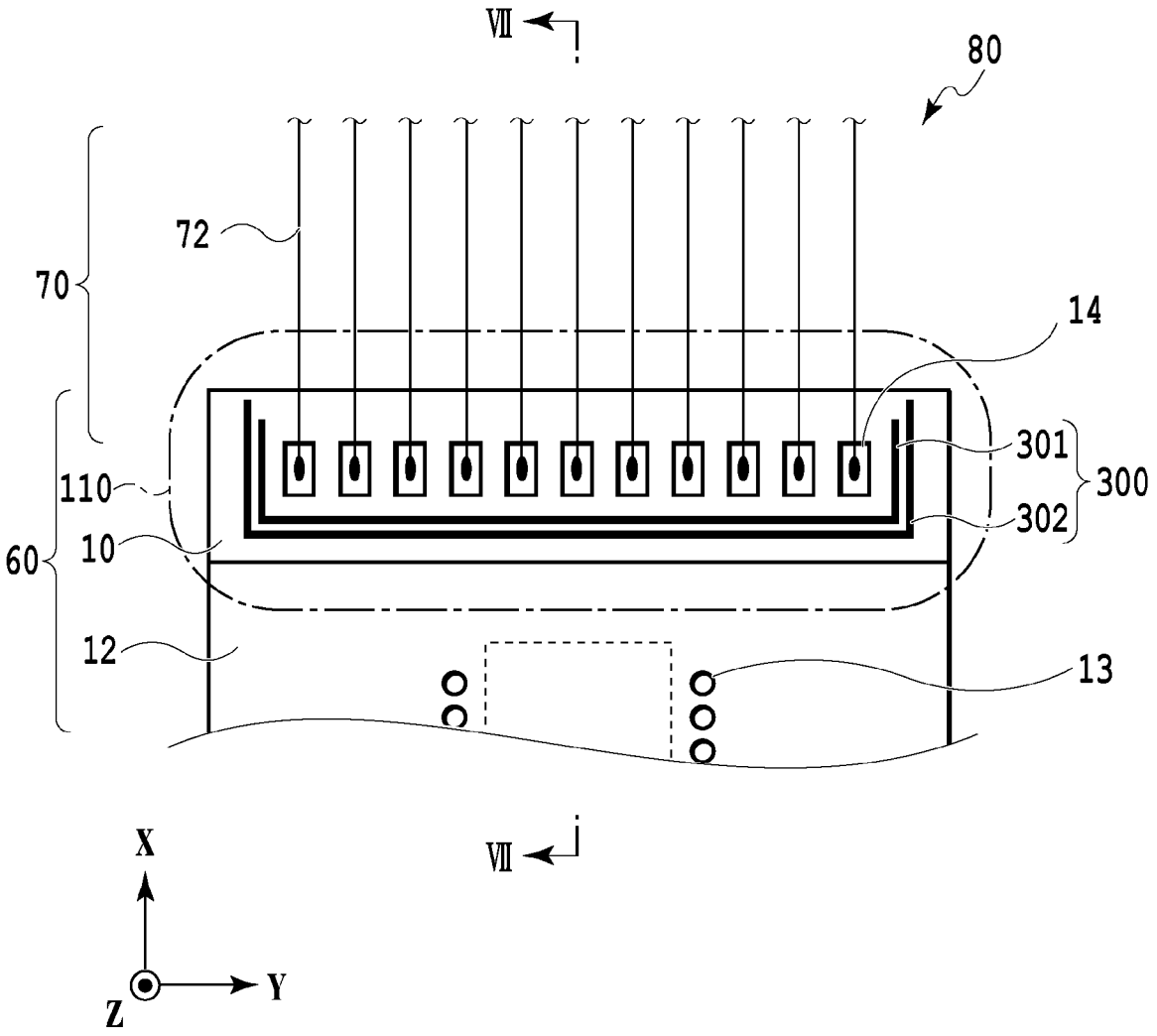
FIG. 6 is a diagram showing a bond between the ejection chip and a flexible wiring substrate.

FIG. 6 shows a state in which the ejection chip 60 and the flexible wiring substrate 70 of the present example are bonded to form the ejection unit 80 (see FIG. 3). The electrode pads 14 on the element substrate 10 are electrically connected with the electrode leads 72 arranged on the flexible wiring substrate 70 by the TAB technology or the like, respectively. After that, the sealing member 110 is applied such that the entire area of the plurality of electrode pads 14 and the ink sensor 300 is covered.

Figure 7:
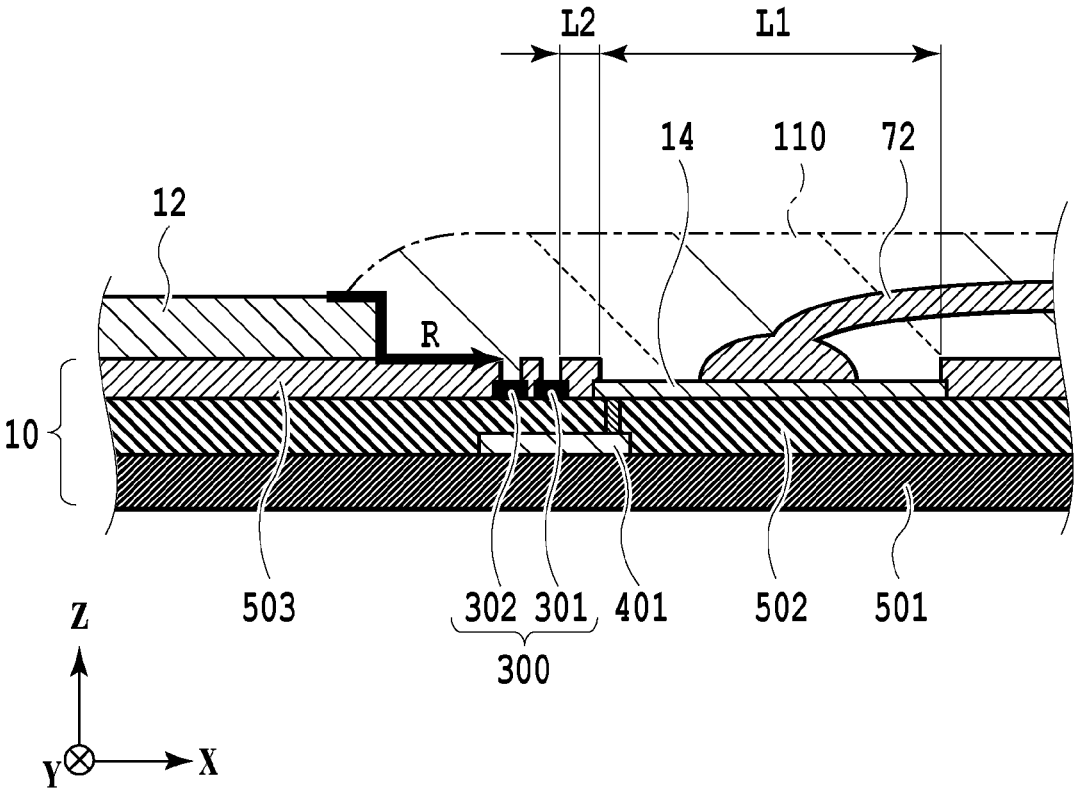
FIG. 7 is a diagram showing a bond between the ejection chip and the flexible wiring substrate.

FIG. 7 is a cross-sectional view of FIG. 6. The element substrate 10 is formed by laminating mainly a first insulation layer 501, a second insulation layer 502, and an adhesion improving layer 503. SiO, for example, may be used as a material for the first insulation layer 501 and the second insulation layer 502. The adhesion improving layer 503 is formed on the periphery of the electrode pad 14, the first wiring 301, and the second wiring 302 in order to improve adhesiveness between the element substrate 10 and the sealing member 110. For example, SiO and SiOC may be used as a material for the adhesion improving layer 503.

The electrode pad 14 is formed at an end in the X direction in the element substrate 10 and the electrode pad 14 is connected with the electrode lead 72 provided on the flexible wiring substrate 70 through wire bonding. Between the electrode pad 14 and the ejection port plate 12, the first wiring 301 and the second wiring 302 constituting the ink sensor 300 are formed with a very small distance therebetween.

As described above, in a state in which the electrode pad 14 on the element substrate 10 is connected with the electrode lead 72 on the flexible wiring substrate 70, the electrode pad 14, the tip of the electrode lead 72, the first wiring 301, and the second wiring 302 are coated by the sealing member 110.

The electrode pad 14 supplies the power and the ejection signal supplied, via intra-layer wiring 401 formed between the first insulation layer 501 and the second insulation layer 502, from the electrode lead 72 to the ejection element 15 (not shown in FIG. 7). Of the plurality of electrode pads 14 arranged on the element substrate 10, the electrode pad 14 shown in the cross-sectional view of FIG. 7 is not connected with the first wiring 301 or the second wiring 302, either.

Figure 8A:
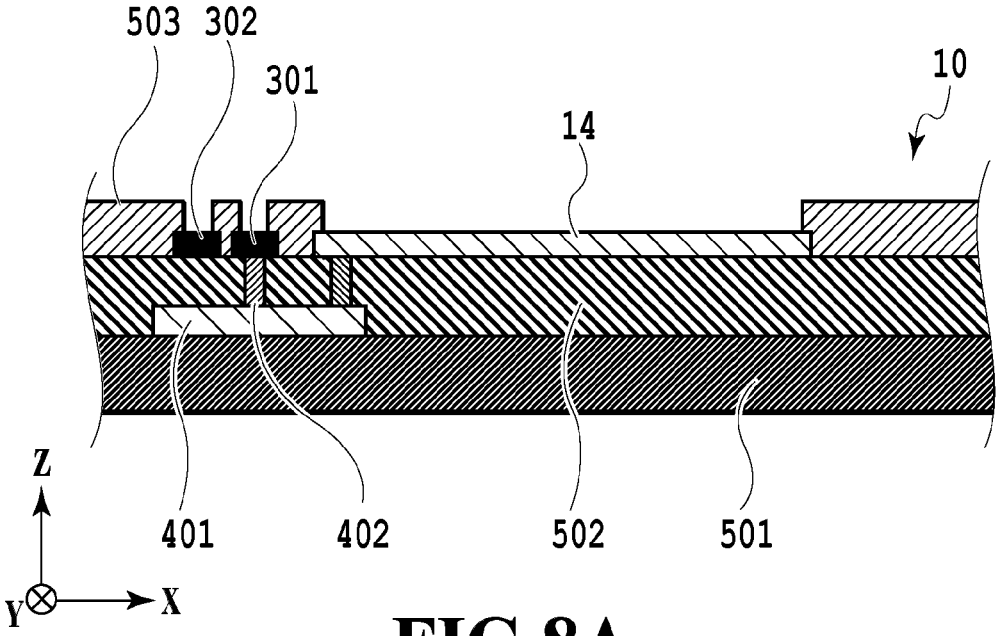
FIGS. 8A and 8B are diagrams showing connection between an electrode pad and each of first wiring and second wiring.
Figure 8B:
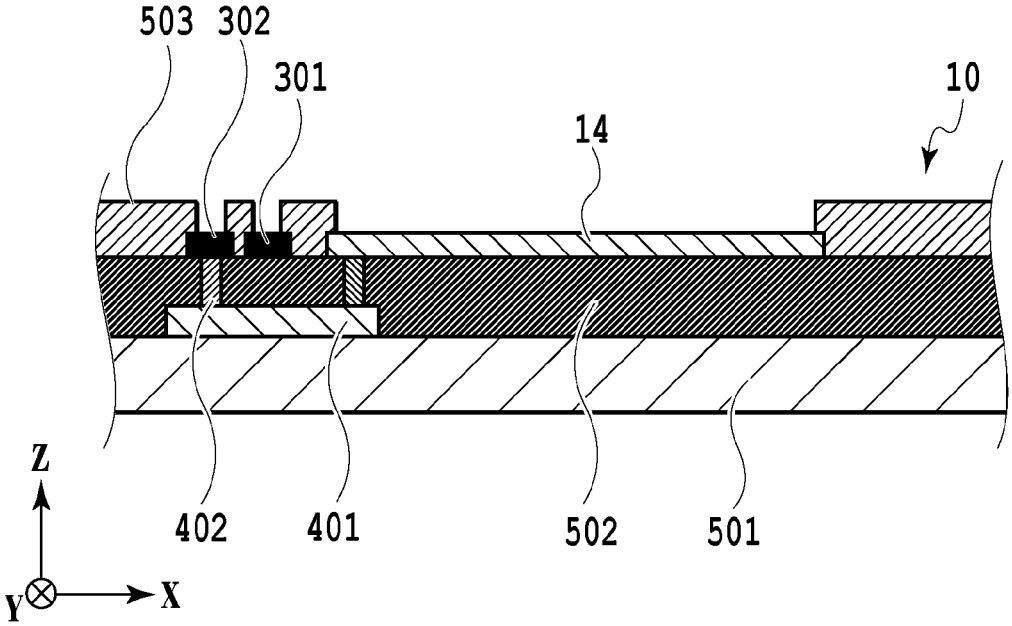

FIGS. 8A and 8B are diagrams showing a cross-sectional view of a portion of the electrode pad 14 which is connected with the first wiring 301 and a cross-sectional view of a portion of the electrode pad 14 which is connected with the second wiring, respectively. FIGS. 8A and 8B show a state before the electrode pad 14 is wire-bonded to the electrode lead 72. The electrode pad 14 of FIG. 8A is connected with the first wiring 301 via two electrode plugs 402 and the intra-layer wiring 401 formed between the first insulation layer 501 and the second insulation layer 502. On the other hand, the electrode pad 14 of FIG. 8B is connected with the second wiring 302 via the two electrode plugs 402 and the intra-layer wiring 401. One electrode pad 14 of the plurality of electrode pads 14 formed on the element substrate 10 is connected with the first wiring 301 in a state shown in FIG. 8A and another electrode pad 14 is connected with the second wiring 302 in a state shown in FIG. 8B. The other electrode pads 14 are connected only with the intra-layer wiring 401 as shown in FIG. 7.

The first wiring 301 and the second wiring 302 are in an open state in a case where these do not contact a foreign substance such as ink. Therefore, if the control unit 101 (see FIG. 1) of the liquid ejection apparatus 1 detects a resistance value between the first wiring 301 and the second wiring 302 via the electrode pads 14 of FIGS. 8A and 8B, a largeenough value is detected. On the other hand, in a case where a liquid such as ink adheres between the first wiring 301 and the second wiring 302, the resistance value between the first wiring 301 and the second wiring 302 detected by the control unit 101 decreases. In other words, the control unit 101 of the present embodiment is capable of monitoring the resistance value between the first wiring 301 and the second wiring 302 to determine that the ink has invaded the sealing member 110 in a case where this resistance value goes below a predetermined threshold value.

With reference to FIG. 7 again, in a case where the liquid ejection head 100 has been used for a long time, since each of the second insulation layer 502, the adhesion improving layer 503, the ejection port plate 12, and the sealing member 110 has the different coefficient of linear expansion, the sealing member 110 gradually comes off from the surface of the element substrate 10 in some cases. In this case, the ink adhering to the ejection port surface of the ejection port plate 12 invades a gap between the sealing member 110 and the element substrate 10 along a path indicated by an arrow R in FIG. 7.

However, in the case of the configuration of the present example, the ink which has invaded the gap contacts and electrifies the first wiring 301 and the second wiring 302 before reaching the electric connection portion between the electrode pad 14 and the electrode lead 72. For this reason, the control unit 101 (see FIG. 1) can detect that the ink is approaching the vicinity of this electric connection portion before the ink reaches the electric connection portion between the electrode pad 14 and the electrode lead 72.

That is, according to the present example, it is possible to determine the ink invasion at a point of time when the ink contacts the wiring without requiring time from when the ink contacts the wiring until the wiring dissolves as in Japanese Patent Laid-Open No. 2010-23480. It is also possible to stop the ejection operation of the liquid ejection head 100 and to prompt a user to exchange the liquid ejection head 100 before the defective ejection is caused by the liquid ejection head 100. Incidentally, in order to suitably obtain such advantageous results, it is preferable that a distance L2 between the first wiring 301 and the electrode pad 14 be equal to or less than 100 μm in a case where the size L1 in the X direction of the electrode pad 14 is between 50 and 300 μm.

Figure 9:
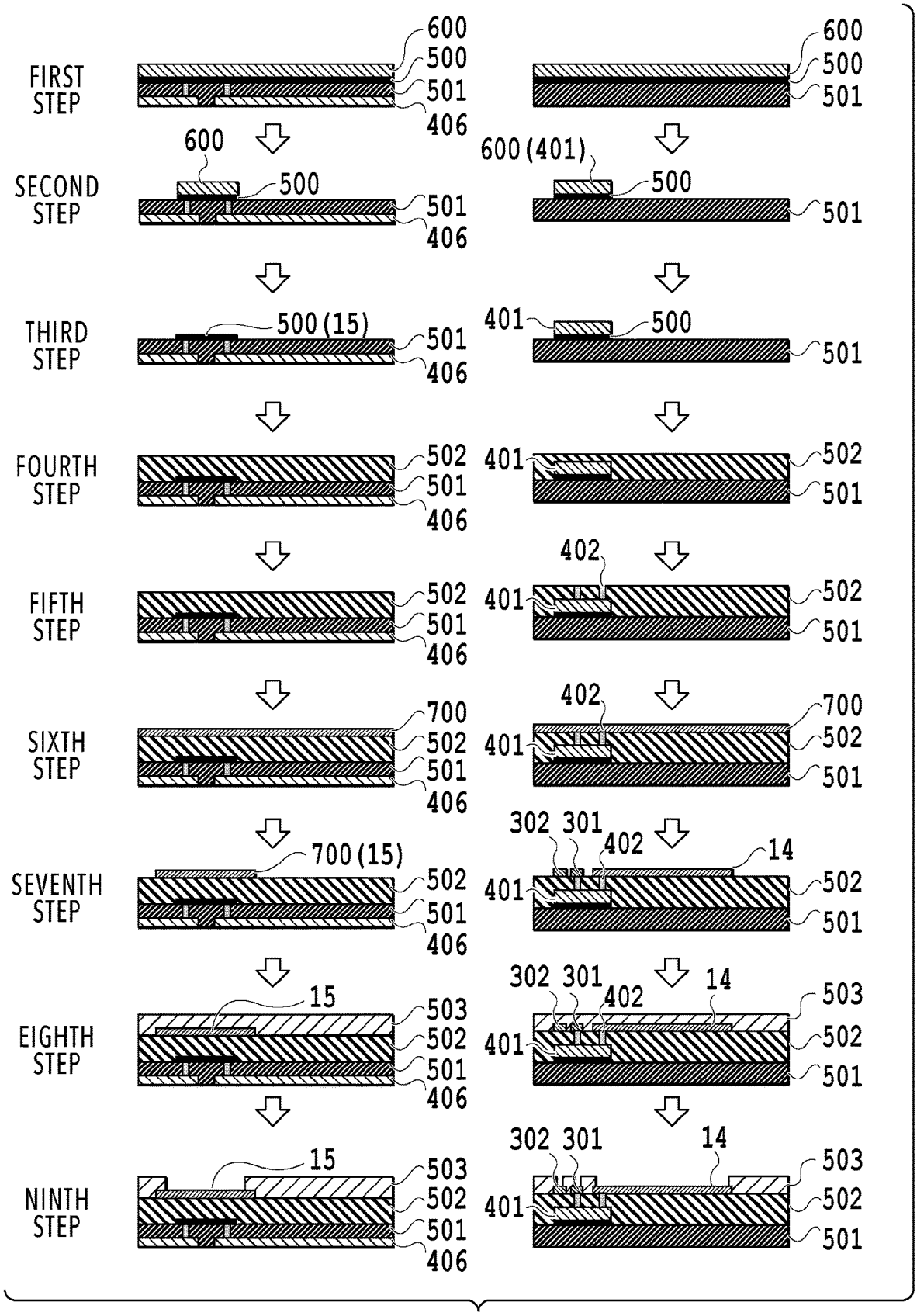
FIG. 9 is a diagram showing a manufacturing process of an element substrate.

FIG. 9 is a diagram showing a manufacturing process of the element substrate 10 of the present example. In the present example, the ejection element 15 arranged at the center, and the electrode pad 14 and the ink sensor 300 arranged at the end are formed by a common process. On the left side of FIG. 9, an ejection portion area forming the ejection element 15 is shown and on the right side of FIG. 9, a wiring area forming the electrode pad 14 and the ink sensor 300 is shown. Attention will be paid to portions forming the ejection element 15, the ink sensor 300, and the electrode pad 14 below and a description as to a forming process for forming a circuit for connecting them and the like will be omitted.

In a first step, a conductive heater layer 500 and a wiring layer 600 are formed on the front surface of the first insulation layer 501 in this order. It is preferable that the thickness of the heater layer 500 be between 10 and 100 nm and suitable materials include TaSiN. It is preferable that the thickness of the wiring layer 600 be between 300 and 1200 nm and suitable materials include AlCu and AlSi. As to the ejection portion area shown on the left side, a through hole which will later be the electrode plug of the ejection element 15 and a wiring layer 406 for supplying the power to the ejection element 15 are already formed in the first insulation layer 501 and on the back surface of the first insulation layer 501, respectively.

In a second step, only part of the heater layer 500 and the wiring layer 600 are left by using dry etching patterning. In the wiring area, the left wiring layer 600 will become the intra-layer wiring 401.

In a third step, the left wiring layer 600 is removed by wet etching in the ejection portion area. The left heater layer 500 will becomes the electrothermal conversion element (heating element) of the ejection element 15 in the ejection portion area.

In a fourth step, the second insulation layer 502 is formed on the front surface of the first insulation layer 501 on which a predetermined pattern is formed.

In a fifth step, in the wiring area, through holes are formed in an area of the second insulation layer 502 corresponding to the intra-layer wiring 401. The through holes will later become the electrode plugs 402.

In a sixth step, an anti-cavitation film 700 is formed on the front surface of the second insulation layer 502. It is preferable that the thickness of the anti-cavitation film 700 be between 50 and 500 nm and suitable materials include Ta (tantalum) and Ir (iridium).

In a seventh step, patterning is performed on the anti-cavitation film 700 formed in the sixth step. In the wiring area, an area of the anti-cavitation film 700 left through the patterning becomes the electrode pad 14, the first wiring 301, and the second wiring 302. In the ejection portion area, the area of the left anti-cavitation film 700 will becomes an area of the ejection element 15 in which the ejection element 15 contacts the ink to cause the film boiling.

In an eighth step, the adhesion improving layer 503 is formed on the front surface of the second insulation layer 502 on which a predetermined pattern is formed. It is preferable that the thickness of the adhesion improving layer 503 be between 200 and 500 nm and suitable materials include SiO and SiOC.

In a ninth step, the patterning is performed on the adhesion improving layer 503 formed in the eighth step. In the wiring area, the electrode pad 14, the first wiring 301, and the second wiring 302 are exposed. In the ejection portion area, the anti-cavitation film 700 which is the ejection element 15 and will contact the ink to cause the film boiling in the ink is exposed. The element substrate 10 of the present embodiment is completed by performing the above steps. The right side of FIG. 9 showing the wiring area shows a cross-sectional view of a portion forming the electrode pad 14 connected with the first wiring 301.

The material for each member described above can be changed as appropriate. However, it is preferable that the anti-cavitation film 700 which directly contacts the ink be made of a metal material which is not easily dissolved by ink and has corrosion resistance. Further, in a case where a material oxidizes, its electrical properties also change, and therefore, it is preferable that the anti-cavitation film 700 be made of a material which does not easily oxidize. With this in mind, in the eighth and ninth steps, another member which can be formed with a material for the anti-cavitation film 700 may be formed together with the electrode pad 14 and the ink sensor 300.

As described above, even in a case where the ink has invaded the sealing member 110, the element substrate 10 of the present example can detect the ink invasion at appropriate timing to prevent in advance the ink from contacting the electric connection portion.

Example 2

Figure 10A:
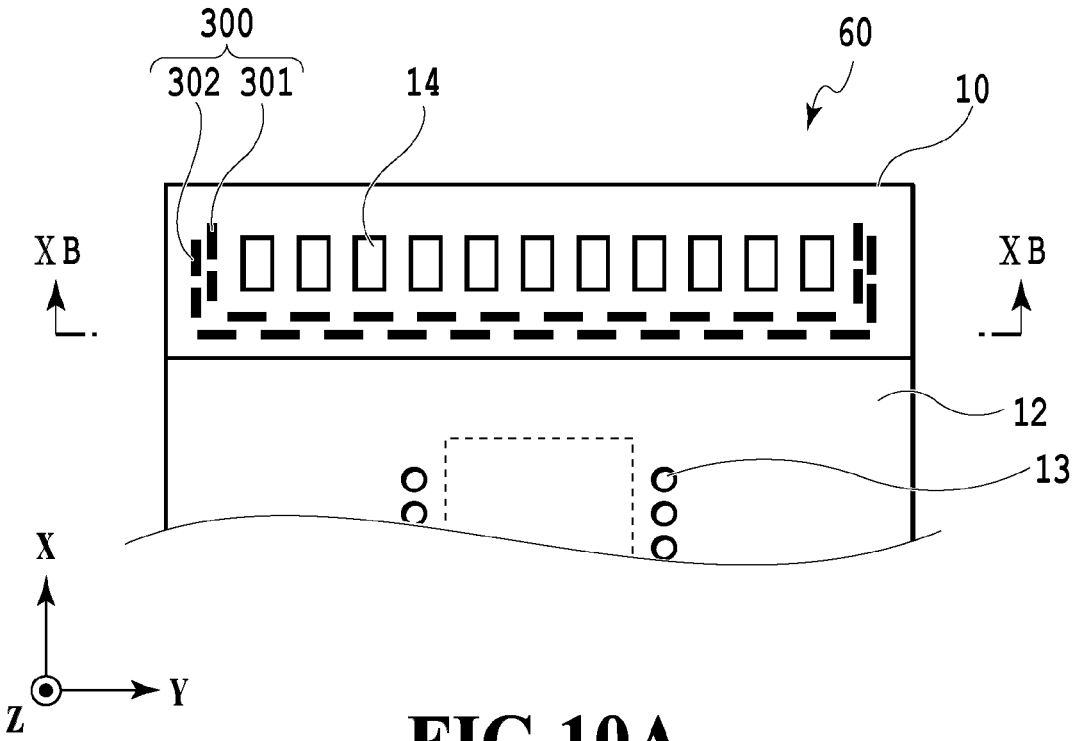
FIGS. 10A and 10B are diagrams showing the ejection chip of Example 2.
Figure 10B:
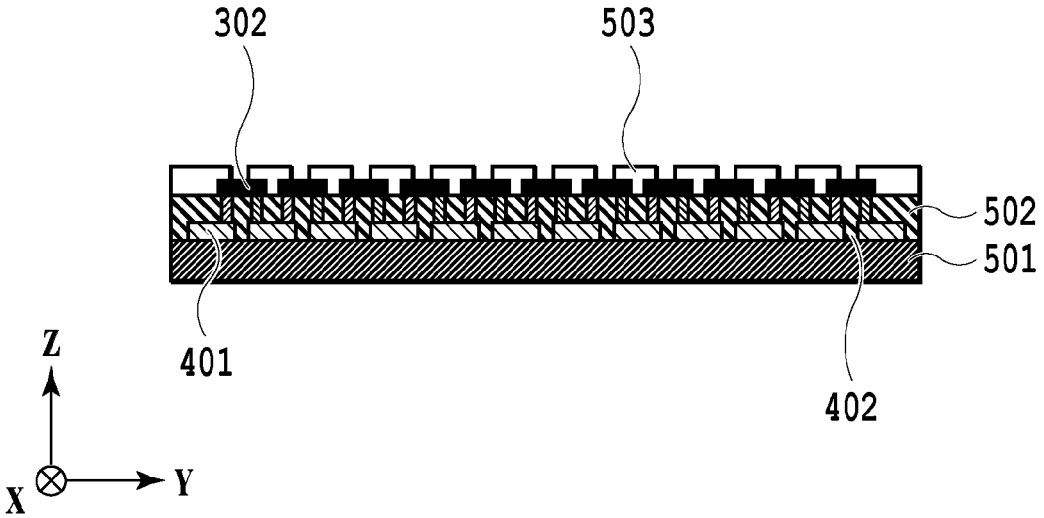

FIGS. 10A and 10B are diagrams showing the ejection chip 60 of Example 2. FIG. 10A is a top view of the ejection chip 60 and FIG. 10B is a cross-sectional view. In the ejection chip 60, the element substrate 10 is exposed in the end area in which the ejection port plate 12 is not arranged.

Also in the element substrate 10 of the present example, similarly to Example 1, the first wiring 301 and the second wiring 302 are arranged in parallel (arranged along each other) and in a U-shape so as to surround the plurality of electrode pads 14. However, in the element substrate 10 of the present example, the first wiring 301 and the second wiring 302 are intermittently formed with a predetermined distance therebetween.

As has been already described, a material such as Ta may be suitably used as the anti-cavitation film 700 to be the ink sensor 300 and the electrode pad 14. However, Ta sometimes cannot obtain high adhesiveness to the resin material forming the sealing member 110. Therefore, in the present example, each of the first wiring 301 and the second wiring 302 is intermittently arranged in a U-shaped path, whereby the area of a portion which is in contact with the sealing member 110 is reduced to be smaller than that of Example 1. In other words, in the U-shaped path, the first wiring 301 or the second wiring 302 having low adhesiveness and the adhesion improving layer 503 excellent in adhesiveness are alternately arranged.

According to such element substrate 10 of the present example, it is possible to further improve the adhesiveness between the element substrate 10 and the sealing member 110 while securing the function of the ink sensor 300 described in Example 1.

Also in the present example, it is possible to manufacture the element substrate 10 by the process described with reference to FIG. 9. In the case of the present example, the patterning may be performed on a position at which the first wiring 301 and the second wiring 302 are to be formed in the seventh step such that the first wiring 301 and the second wiring 302 are discontinuous in the U-shaped area.

Example 3

Also in the present example, the first wiring 301 and the second wiring 302 are arranged in a U-shape similarly to the above examples. However, in the present example, the first wiring 301 and the second wiring 302 are made of different materials. More specifically, the first wiring 301 which is close to the electrode pad 14 is formed by performing the patterning on the anti-cavitation film 700 similarly to the above examples. On the other hand, the second wiring 302 which is far from the electrode pad 14 uses the intra-layer wiring 401 formed by the wiring layer 600 as it is as the second wiring 302. In the case of using the intra-layer wiring 401 as the second wiring 302, it is preferable that the wiring layer 600 be formed with a material including one or more of Al, Cu, and Si.

Figure 11A:
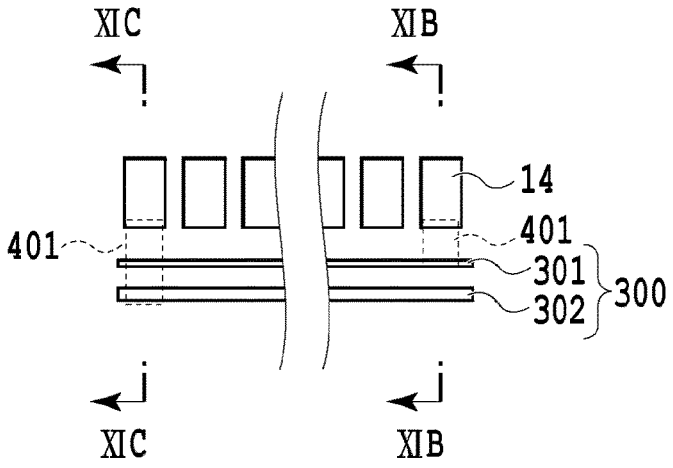
FIGS. 11A to 11C are diagrams showing the element substrate of Example 3.
Figure 11B:
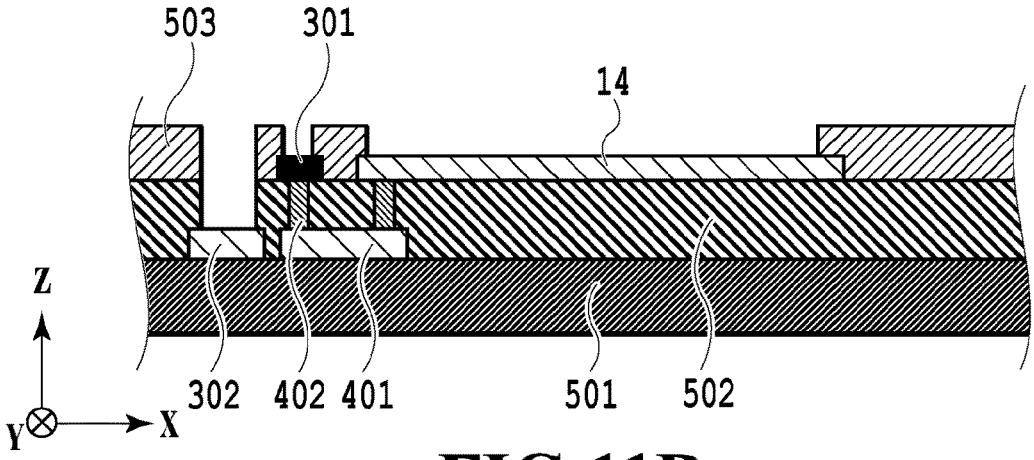
Figure 11C:
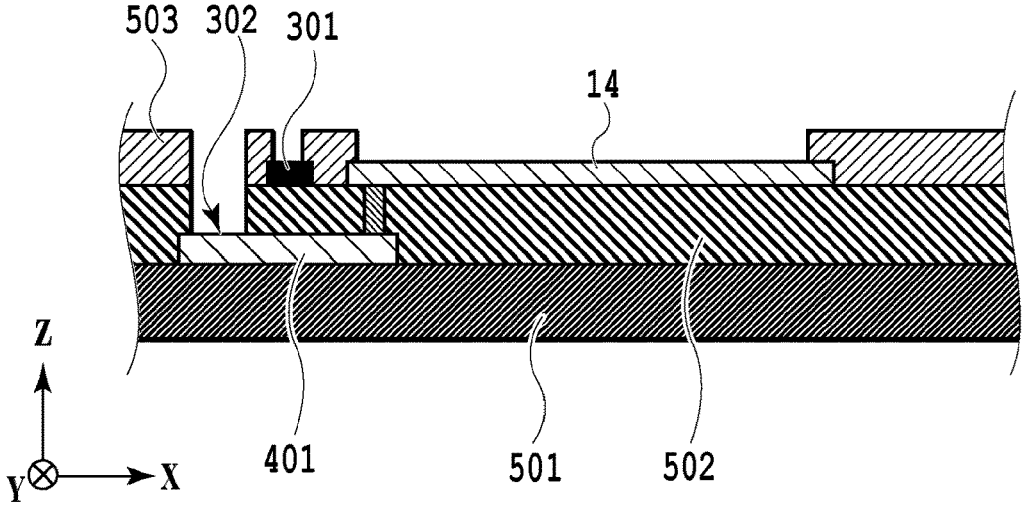

FIGS. 11A to 11C are diagrams showing the element substrate 10 of the present example. FIG. 11A is a top view showing the vicinity of the electrode pads 14 and the ink sensor 300. FIG. 11B is a cross-sectional view of a portion of the electrode pad 14 connected with the first wiring 301 and FIG. 11C is a cross-sectional view of a portion of the electrode pad 14 connected with the second wiring 302.

In the present example as described above, the ink which invades from the ejection port surface enters a recess of the second wiring 302 and then contacts the first wiring 301. Even in the form described above, the control unit 101 can detect the ink invasion based on a decrease in the resistance value between the first wiring 301 and the second wiring 302. Incidentally, in the present example, the first wiring 301 is formed with the anti-cavitation film 700 and the second wiring 302 is formed with the wiring layer 600. However, it is also effective that the first wiring 301 is formed with the wiring layer 600 and the second wiring 302 is formed with the anti-cavitation film 700.

Also in the present example, it is possible to manufacture the element substrate 10 by the process described with reference to FIG. 9. In the case of the present example, it is only necessary that the intra-layer wiring 401 and the second wiring 302 be formed in the second step and that the electrode pad 14 and the first wiring 301 be formed in the seventh step. Further, in the fifth step, it is only necessary that a through hole which is connected with the first wiring 301 be formed.

Example 4

Figure 12:
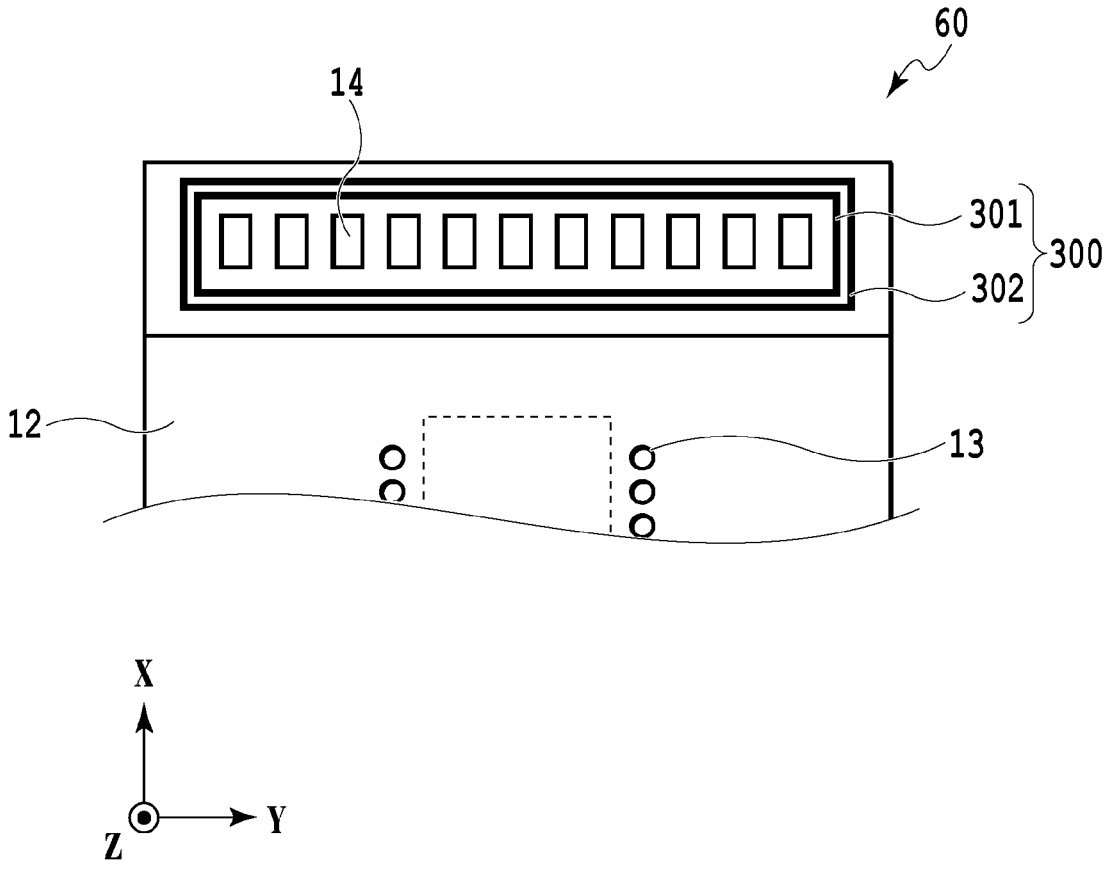
FIG. 12 is a top view showing the ejection chip of Example 4.

FIG. 12 is a top view showing the ejection chip 60 of the present example. In the element substrate 10 of the present example, the first wiring 301 and the second wiring 302 are arranged so as to completely surround the periphery of the plurality of electrode pads 14. This means that the second wiring 302 is arranged to further surround the plurality of electrode pads 14 and the first wiring 301 surrounding these electrode pads 14.

In a case where it is presumed that an invasion path for the ink is limited as shown by the arrow R of FIG. 7, it is only necessary for the ink sensor 300 to be arranged before the electrode pad in the invasion path. However, in a case where the invasion path for the ink is not limited and there is concern about invasions from various directions, as in the present example, it is preferable that the ink sensor 300 be arranged so as to completely surround the plurality of electrode pads 14. In this manner, even in a case where the ink invades from any direction, the control unit 101 (see FIG. 1) can detect that the ink is approaching the vicinity of the electric connection portion before the ink reaches the electric connection portion between the electrode pads 14 and the electrode leads 72.

Also in the present example, it is possible to manufacture the element substrate 10 by the process described with reference to FIG. 9. In the case of the present example, it is only necessary that the patterning be performed on the first wiring 301 and the second wiring 302 in the seventh step so as to completely surround the plurality of electrode pads 14.

Example 5

Also in the present example, the first wiring 301 and the second wiring 302 are arranged in a U-shape similarly to Example 1. In the element substrate 10 of the present example, part of the first wiring 301 and the second wiring 302 are coated with an adhesion improving layer 403.

Figure 13:
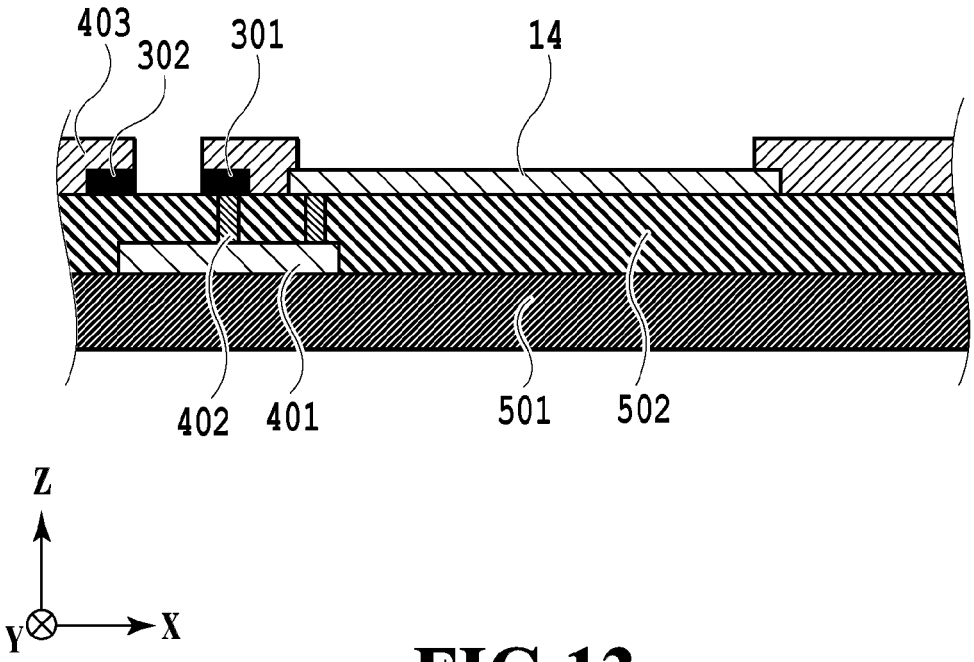
FIG. 13 is a cross-sectional view showing the element substrate of Example 5.

FIG. 13 is a cross-sectional view showing the element substrate 10 of the present example. FIG. 13 shows the cross-sectional view of the portion of the electrode pad 14 connected with the first wiring 301. In the present example, the first wiring 301 and the second wiring 302 except for their side surfaces which face each other are coated with the adhesion improving layer 403. More specifically, the front surfaces (surfaces in the Z direction) of the first wiring 301 and the second wiring 302, a side surface in +X direction of the first wiring 301, and a side surface in −X direction of the second wiring 302 are coated with the adhesion improving layer 403.

According to the present example described above, the ink which has invaded between the first wiring 301 and the second wiring 302 contacts the first wiring 301 and the second wiring 302, whereby the control unit 101 can detect the ink invasion. In addition, the anti-cavitation film 700 does not contact the sealing member 110 and the adhesiveness between the element substrate 10 and the sealing member 110 can be improved as compared with Example 1. That is, according to the present example, the adhesiveness between the element substrate 10 and the sealing member 110 can further be improved while securing the function of the ink sensor 300 described in Example 1.

Also in the present example, it is possible to manufacture the element substrate 10 by the process described with reference to FIG. 9. In the case of the present example, it is only necessary that the patterning be performed on the adhesion improving layer 503 in the ninth step such that only the side surfaces facing each other of the first wiring 301 and the second wiring 302 are exposed.

Other Embodiments

The configurations of Example 1 to Example 5 described above may be combined with each other. For example, Example 3 and Example 4 may be combined to arrange the first wiring 301 and the second wiring 302 so as to completely surround the periphery of the plurality of electrode pads 14 while the first wiring 301 and the second wiring 302 are formed with the different materials.

Although a configuration in which the plurality of electrode pads are arranged in a row in the Y direction has been described above as an example, the electrode pads may be arranged in two or more rows. However, as to the first wiring and the second wiring, it is preferable that at least part of an area thereof be arranged along a direction in which the plurality of electrode pads are arranged.

Further, although the first wiring 301 has been arranged at the distance of 100 μm or less from the electrode pad 14 in the above description, a distance between the first wiring 301 and the electrode pad 14 can be changed as appropriate. In a case where the distance between the first wiring 301 and the electrode pad 14 is too short, there is concern that the ink might invade the electric connection portion during the ejection operation, and in a case where the distance between the first wiring 301 and the electrode pad 14 is too long, there is concern that the life of the liquid ejection head might be shorter than is necessary. In either case, the distance between the first wiring 301 and the electrode pad 14 may be appropriately adjusted according to the size in the X direction of the electrode pad 14, the thermal properties of each member which forms the element substrate 10, the properties of ink, and the like.

A serial inkjet printing apparatus which ejects the ink while scanning the liquid ejection head 100 by the carriage motor has been described above as the example of the liquid ejection apparatus. However, the above embodiments can also be applied to a full-line inkjet printing apparatus and a full-line printing head. Further, although the liquid ejection head 100 of cartridge-type in which the ejection unit 80 and the ink tank 90 are configured in an integrated way has been described as an example in FIG. 2, the ejection unit 80 and the ink tank 90 may be provided separately. For example, a form may be applied in which the ink is supplied from an ink tank fixed in the apparatus via a tube or the like to an ejection unit moving in the apparatus.

According to the present invention, it is possible to appropriately detect the invasion of the vicinity of the electric connection portion by the ink to prevent in advance the ink from contacting the electric connection portion.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-206567, filed Dec. 14, 2020, which is hereby incorporated by reference wherein in its entirety.

What is claimed is:

1. An element substrate of a liquid ejection head comprising:

an ejection element configured to eject a liquid;

an electrode pad array in which there are arranged a plurality of electrode pads configured to externally receive power for causing the ejection element to eject the liquid; and a sensor configured to detect that the liquid has invaded a vicinity of the plurality of electrode pads, wherein the sensor comprises first wiring electrically connected with one electrode pad in the electrode pad array and second wiring electrically connected with another electrode pad different from the one electrode pad electrically connected with the first wiring in the electrode pad array.

2. The element substrate according to claim 1, wherein the first wiring and the second wiring are made of a corrosion-resistant metal material which is not dissolved by the liquid ejected by the ejection element.

3. The element substrate according to claim 1, wherein the first wiring and the second wiring are made of tantalum or iridium.

4. The element substrate according to claim 1, wherein the first wiring and the second wiring are arranged in parallel between the ejection elements and the electrode pad array, and wherein the electrode pay array, the first wiring, the second wiring, and the ejection element are arranged in this order in a direction intersecting a direction in which the electrode pad array extends, in planar view.

5. The element substrate according to claim 1, wherein at least part of the first wiring and the second wiring are arranged along a direction in which the plurality of electrode pads are arranged.

6. The element substrate according to claim 1, wherein the first wiring is arranged to surround a periphery of the electrode pad array and the second wiring is arranged to surround a periphery of the electrode pad array and the first wiring.

7. The element substrate according to claim 1, wherein the first wiring and the second wiring are made of a different material.

8. The element substrate according to claim 1, wherein an area around the electrode pad array, the first wiring, and the second wiring is coated with a material having higher adhesiveness to a sealing member for protecting the element substrate as compared with the area of the first wiring and the second wiring.

9. The element substrate according to claim 1, wherein the first wiring and the second wiring have a thickness of between 50 and 500 nm.

10. The element substrate according to claim 1, wherein the first wiring is at a distance of 100 μm or less from an electrode pad located closest to the first wiring of the electrode pad array.

11. The element substrate according to claim 1, wherein the element substrate comprises an insulation layer on a surface of which the electrode pads are provided, the first wiring is electrically connected with the electrode pad via intra-layer wiring and a plug provided in the insulation layer.

12. A liquid ejection head comprising:

an element substrate including:

an ejection element configured to eject a liquid;

an electrode pad array in which there are arranged a plurality of electrode pads configured to externally receive power for causing the ejection element to eject the liquid; and a sensor configured to detect that the liquid has invaded a vicinity of the plurality of electrode pads, an ejection port plate which is laminated on the element substrate, and on which a plurality of ejection ports for ejecting the liquid by a plurality of the ejection elements and a flow passage for leading the liquid to each of the plurality of ejection ports are formed; and a wiring substrate on which a plurality of electrode leads for being electrically connected with the plurality of electrode pads respectively are formed, wherein the sensor comprises first wiring electrically connected with one electrode pad in the electrode pad array and second wiring electrically connected with another electrode pad different from the one electrode pad electrically connected with the first wiring in the electrode pad array.

13. The liquid ejection head according to claim 12, wherein a connection portion between the plurality of electrode pads and the plurality of electrode leads, the first wiring, and the second wiring are coated with a resin material.

14. A liquid ejection apparatus capable of mounting a liquid ejection head, the liquid ejection head comprising:

an element substrate including:

an ejection element configured to eject a liquid;

an electrode pad array in which there are arranged a plurality of electrode pads configured to externally receive power for causing the ejection element to eject the liquid; and a sensor configured to detect that the liquid has invaded a vicinity of the plurality of electrode pads, an ejection port plate which is laminated on the element substrate, and on which a plurality of ejection ports for ejecting the liquid by a plurality of the ejection elements and a flow passage for leading the liquid to each of the plurality of ejection ports are formed; and a wiring substrate on which a plurality of electrode leads for being electrically connected with the plurality of electrode pads respectively are formed, wherein the sensor comprises first wiring electrically connected with one electrode pad in the electrode pad array and second wiring electrically connected with another electrode pad different from the one electrode pad electrically connected with the first wiring in the electrode pad array, and the liquid ejection apparatus comprises a detection unit configured to detect a resistance value between the electrode pad electrically connected with the first wiring and the electrode pad electrically connected with the second wiring in the electrode pad array, and a determination unit configured to determine that the liquid has invaded the vicinity of the electrode pad array in a case where the resistance value detected by the detection unit goes below a predetermined threshold value.

* * * * *